United States Patent [19]

Chattin

[11] Patent Number: 4,887,582

[45] Date of Patent: Dec. 19, 1989

[54] GEAR MECHANISM FOR COMPOUND BOW

[76] Inventor: Jesse R. Chattin, 7201 South 49th Street, Tampa, Fla. 33619

[21] Appl. No.: 301,724

[22] Filed: Jan. 26, 1989

[51] Int. Cl.[4] ..... F41B 5/00

[52] U.S. Cl. ..... 124/23 R; 124/DIG. 1; 74/802

[58] Field of Search ..... 124/DIG. 1, 23 R, 90, 124/86; 29/526.1, 526.2; 74/802

[56] References Cited

U.S. PATENT DOCUMENTS

| | | | |
|---|---|---|---|
| 2,823,561 | 2/1958 | Opocensky | 74/802 |
| 4,201,177 | 5/1980 | Holman et al. | 124/DIG. 1 |
| 4,660,536 | 4/1987 | McPherson | 124/DIG. 1 |
| 4,724,820 | 2/1988 | Chattin | 124/DIG. 1 |
| 4,770,154 | 9/1988 | Cook et al. | 124/DIG. 1 |

FOREIGN PATENT DOCUMENTS

| | | | |
|---|---|---|---|
| 1091658 | 4/1955 | France | 74/802 |

*Primary Examiner*—Randolph A. Reese
*Assistant Examiner*—Anthony Knight
*Attorney, Agent, or Firm*—Frijouf, Rust & Pyle

[57] ABSTRACT

There is disclosed a pulley mechanism for a compound bow which allows the drawstring to move through its full range of motion while the compound bow bends only a relatively short distance. Because the compound bow returns to its resting position quickly, the resultant forward motion of the drawstring is faster and thus the arrow moves with greater speed and accuracy. The drawstring pulley of the compound bow is driven by a center gear mating with a fixed gear at the end of the bow arm. The drawstring pulley is thus driven in an orbit around the end of the bow arm. In turn, the compound bow power pulley is driven in an orbit centered by an off-set hub and powered from its center by the motion of the drawstring pulley. The drawstring pulley is free to revolve on full revolution while the power pulley only revolves one-half turn. Because the actural circumference of the power pulley is round while the pulley circumscribes an elliptical arc (due to the off-set center point) there is a smoth "break-over" when the drawstring is released. Arrow quiver is reduced by the smooth break-over as well as by the reduced arc through which the bow ends must move upon release of the drawn bow string.

34 Claims, 4 Drawing Sheets

GEAR MECHANISM FOR COMPOUND BOW

BACKGROUND OF THE INVENTION

1. Field of the Invention

This invention relates to a compound bow and more particularly to a pulley mechanism for controlling the speed and draw capabilities of such bows.

2. Description of Prior Art

The bow and arrow is a fundamental tool of civilization. From the earliest times, hunters have been bending limbs and using the resilient force of the bent wood to propel arrows in seach of food and for self-protection. Isaac Newtown provided us with the mathematical relationships showing that the distance an arrow will travel without dropping is a function of the speed of the arrow as it leaves the bow. Wars have been fought with bows and arrows and, as one would expect, the search continues for bows having great accuracy and thus high arrow speed.

Arrow speed is determined by how fast a pulled drawstring returns to the neutral position. This speed, in turn, is traditionally determined by the hysterisis (memory) effect of the bent bow limb. Since the speed with which a bent bow returns to the neutral position is directly related to the force required to bend the bow limb, it follows that as higher arrow speeds are desired larger draw forces are required to bend the limb. Accordingly, since there is a practical limit to how much force a person can use to pull the drawstring, there is an upper limit on arrow speed.

A major solution to this problem was the advent of the compound bow, where a pulley system is used to allow the drawstring to be pulled back a large distance while only requiring the limb of the bow to move a much smaller distance.

Typically, a compound bow has two pulleys (usually in the shape of cams) one we will call the drawstring pulley and the other, for convenience, we will call the power or tension pulley. These two pulleys are connected together to form a set and the end of each limb of the bow is fitted with such a set. The tension pulley has a tension cable attached permanently to it is the circumferential rim, the other end of the cable being attached to the other limb end. The tension cables from the two tension pulleys (one at each limb end) thus cross each other at the center of the bow. The drawstring pulleys each terminate one end of the drawstring on their respective circumferential rims, such that as the drawstring is pulled back the two drawstring pulleys rotate. This rotation causes the two tension pulleys to also rotate thereby winding a portion of the tension cables onto each tension pulley. Since the far end of each tension cable is fixed to an end of the bow limb, the limbs bend as the drawstring is pulled into the drawn position.

When the drawstring is fully drawn, the cam nature of the tension pulleys "break-over" thereby allowing the drawstring to be held with much less force than is actually required to pull the string back.

When the drawstring is released, the limbs return to their normal condition causing the tension pulleys to unwind, thereby pulling the drawstring forward.

Compound bows, which partially solve the bow bending dilemma, have become very popular in recent years. However, even the best compound bow has limitations in the speed of forward movement of a released drawstring. This speed is controlled by the mechanism used to return the drawstring to its normal position. Typically, with a compound bow, the tension cable moves four inches representing a four inch bending of the limb. Thus, the tension cable must move four inches while the drawstring moves about six inches from the normal position to the fully drawn position.

Because the draw string is attached to a cam which is off center to give leverage and because this cam is fixed to the tension cam which controls the tension cable, this relationship is fixed. Or to say it another way, because of the relative circumferential areas of the two cams, there can only be an approximately 3:1 difference in string length between the drawstring and the tension cable. If the relative sizes of two cams were to be changed then the drawstring cam would become so large that it would unbalance the bow because of the mass at the ends of the bow limbs. Speed might possibly be increased, but only at the price of increased arrow wobble due to the vibration of the bow as the large mass of the cams move from the drawn position to the normal position.

Another problem stemming from the use of compound bows is the use of the cam itself. This problem comes from the "break-over" motion of the cam as it goes "over-center" near the end of the draw. Upon release of the drawstring the over center action of the cam imparts a vibration to the arrow which affects the arrow's flight path as well as its ultimate accuracy.

A still further problem with compound bows is that as the force increases, the bow arms are forced to move further and thus have a tendency to fatique and break.

Thus, it is desirable to design a compound bow gear system which allows for high arrow speed without introducing quiver to the arrow as it leaves the drawstring.

It is further desirable to provide such a compound gear system which allows a stronger bow limb to be used without introducing additional drawstring pulling forces and without requiring large bending movements of the bow arms.

It is further desirable to design a mechanism for a compound bow which eliminates the "break-over" problem and which also does not introduce bow quiver by the movement of a large mass at the bow limb ends.

It is a further desire to design such a mechanism which will impart a faster arrow speed upon release of the drawstring while allowing the bow arm limited movement.

The foregoing has outlined some of the more pertinent objects of the present invention. These objects should be construed to be merely illustrative of some of the more pertinent features and applications of the invention. Many other beneficial results can be obtained by applying the disclosed invention is a different manner of modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The problems with the prior art have been solved by arranging a compound bow with a gear mechanism which allows the drawstring to move through its full range of motion while the compound bow bends only a relatively short distance. Because the compound bow returns to its resting position quickly, the resultant forward motion of the drawstring is faster than with previous compound bows and thus the arrow moves with greater speed and accuracy.

The drawstring pulley is driven in an orbit around the end of the bow arm. In turn, the compound bow tension pulley is driven in an orbit centered by an off-set hub and powered from its center by the motion of the drawstring pulley. The drawstring pulley is free to revolve one full revolution while the tension pulley only revolves one-half turn. Because the actual circumference of the tension pully is round while the pulley circumscribes an elliptical arc (due to the off-set center point) there is a smooth "break-over" when the drawstring is released, thereby eliminating arrow quiver.

The bending of the compound bow is controlled by the tension pulley operating in conjunction with an off-center drive such that the drawstring moves through a ratio of six to one so that the drawstring can be pulled back roughly twelve inches while the compound bow bends only two inches. Thus, when the drawstring is released, it moves through a range of twelve inches during the time it takes for the compound bow to move through an arc of two inches. In this manner, the arrow moves through a given space in less time then previously and thus leaves the drawstring with a greater velocity.

There are two force moments created. The first force moment is between the circumferential rim of the drawstring pulley and a gear central thereto. This gear, or drive wheel, rotates around a fixed gear (drive wheel) mounted at the end of the bow limb. The second force moment is established by rotating about the limb end at a point off-set from its center point. The center point of the tension pulley is connected to the center of the drawstring pulley thereby creating a turning moment greater than currently possible with existing compound bows. This allows a much stronger bow limb to be used, which in turn imparts more forward momentum to the drawstring.

For example, in prior art compound bows, to achieve the equivalent of a straight bow 50 pound draw pull, the archer need only exert a 25 pound pull to the drawstring. Under the present invention, to achieve a 50 pound draw pull the archer need only exert a 15 pound draw pull. This mechanical advantage translates into the ability to equip the compound bow with more resilient (stronger) bow arms. Thus, with an equivalent amount of force on the drawstring, the bow limb will bend two inches and retain the same memory force that would have been required to bend a less strong bow limb four inches under the compound bows of the past. Accordingly, a two inch bent bow limb under this invention stores the same energy as does a four inch bent bow limb of prior compound bows.

This result is achieved by decoupling the rotating motion of the draw pulley from the tension pulley. In the prior art, the two pulleys were fixed on a common center and rotated in conjunction with each other such that the wind-up capabilities of the two pulleys were fixed relative each other. Under that arrangement, if different draw lengths were to be achieved, the relative cam size would have had to be adjusted. This was impractical to achieve because of inherent weight and size limitation on the pulleys.

Using the existing cam arrangement for compund bows the search for faster arrow speeds runs into many problems, all connected with the fact that the efforts were directed to making different cam configurations. However, since to rotational movement of the two cams remained a function of the relative sizes of the two cams, the result has been a fixed upper arrow speed limit.

In addition, since the bow bends four inches, the crossed tension cables must move four inches and again this causes vibration in the bow. Numerous patents, including my U.S. Pat. No. 4,724,820, issued Feb. 16, 1988, hereby incorporated by reference, have been directed to solving this problem. Under the present invention, the small movement of the tension cables reduces the effect of vibration. Also, since the pulleys rotate without break-over, they turn smoother, again reducing bow quiver.

Accordingly, it is a feature of the invention to provide a control mechanism for a bow having a first pulley for attachment to one end of the drawstring of the bow, the pulley having an interior orbit controlling a portion for rotating about the ends of the bow limb, and a second pulley for attachment to one end of the tension cable, the second pulley having a pivot point off-set from the center for rotating the second pulley around the bow limb end under power imparted to it from the center of the first pulley as the first pulley traverses on orbit around the bow limb end.

Another feature of this invention is to provide a compound bow having high arrow speed, small tension cable movement, low holding force and smooth arrow acceleration.

Still another feature of the invention is to provide a replacement for the cams of a compound bow with a set of pulleys allowing for easier bending of the limbs and a smooth drawstring acceleration upon release from the drawn position.

Still another feature of the invention is to provide a compound bow with a gear assembly which allows a stronger bow limb to be bent a small distance while increasing arrow speed because of the relative movement of the drawstring to the bent bow hysterisis movement.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DISCUSSION

Figures 1, 2, 3:
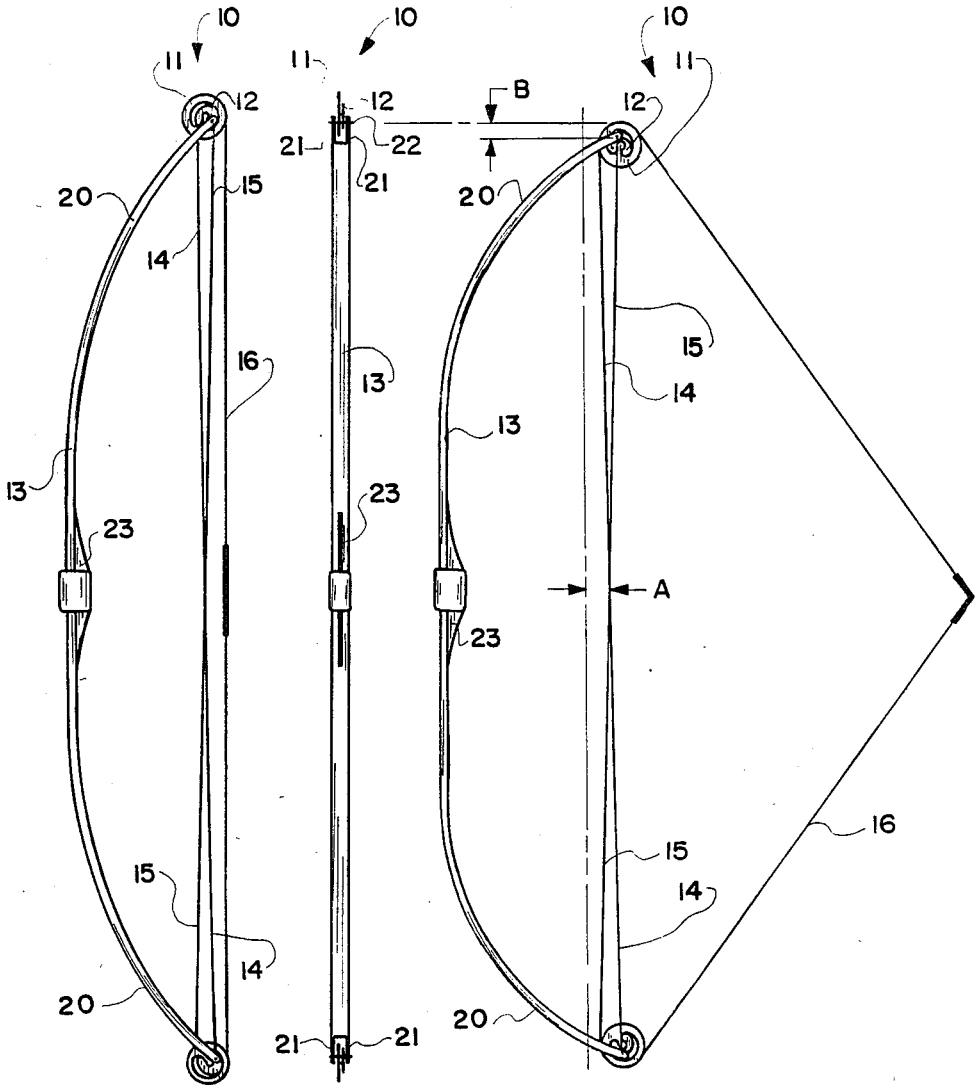
FIGS. 1 and 2 show side and rear views of the pulley system mounted on a compound bow with the bow in the rest or quiescent position.
FIG. 3 shows a side view of the pulley system mounted on a compound bow with the bow in the drawn position.

Turning now to FIG. 1, there is shown compound bow 13 resting in the normal or quiescent position. Bow 13 has hand grip section 23 and pulley 10 mounted on upper and lower limbs 20. Power or tension cables 14 and 15 serve to interconnect the pulley of one limb with the opposite limb. Drawstring 16 interconneects the upper and lower limb pulleys.

FIG. 2 shows the rear view of bow 13. Tines 21 can be seen at the top and bottom limbs. Between these tines, pulleys 10 are pinned via pin 22 in the manner to be discussed hereinafter. Tines 21 can be seen in more detail in FIG. 6.

In FIG. 3 the compound bow is shown in the drawn position with drawstring 16 pulled backward. In this position, the drawstring has unwound from its control pulleys causing tension cables 14 and 15 to wind on their respective control pulleys thereby forcing limb ends 20 to bend back and down slightly. The backwards bend is shown by "A" in FIG. 3, while the downwards bend is shown by "B". As will be seen, upon the relase of drawstring 16, the power of the bow ends returning to their quiescent position pulls drawstring 16 forward while at the same time causing its control pulley 10 to rotate as the tension cable pulley rotate in response to the unwinding of the tension cables. This will be seen in more detail from that which follows.

Figure 6:
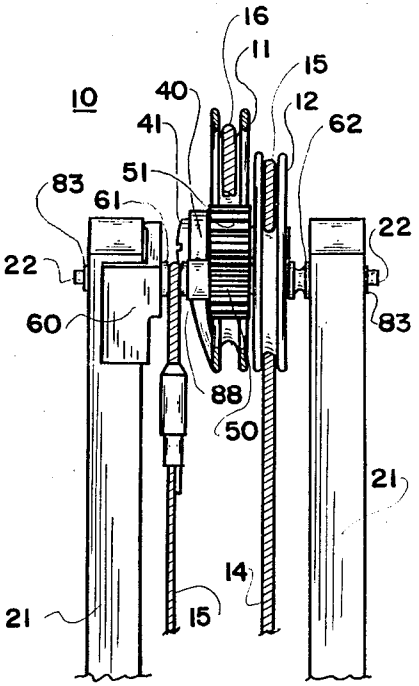
FIG. 6 is a rear view of the pulley system with structures of one of the pulleys removed to show the gear relationships.
Figure 4:
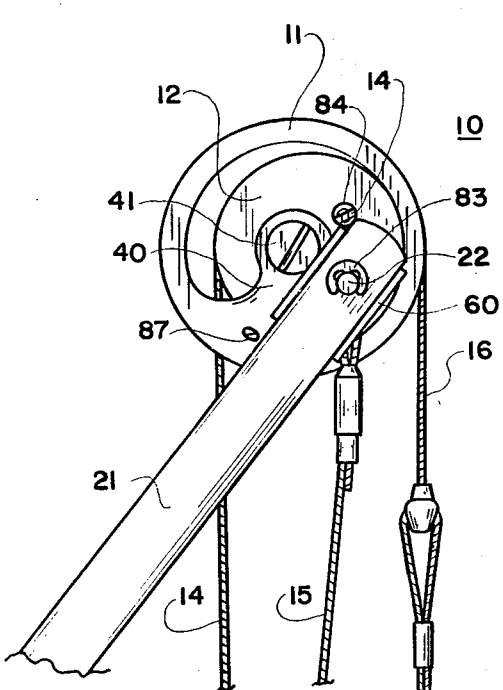
FIG. 4 is a side view of the pulley system.

FIG. 4 shows tine 21 at the limb end which, for our discussion, can be the upper or lower limb end since the same mechanism is repeated at both ends. Assuming that FIG. 4 shows the upper limb end, then tension cable 14 begins on pulley 12 and extends downward and is connected to the lower limb end 20 in the same manner as cable 15 is connected to the upper limb end, as shown in FIG. 6. Note that cable 15 can end in a bridle, thus being connected to support 62 as well as support 61. Thus, when pulley system 10 rotates, tension cable 14 is free to wind upon circumferential rim 12 thereby bending the other or lower limb end. Of course the same is true for tension cable 15 which is pulled downward by the winding of pulley 12 at the lower end (not shown).

In the quiescent position, drawstring 16 is wound onto the circumferential rim of cam 11. Drawstring 16 being pulled into the drawn position causes pulley 11 to rotate in the clockwise direction thereby causing pulley 12 (the tension pulley) to also rotate in the clockwise direction. The exact relationship between these two pulleys will be detailed hereinafter.

Figure 5:
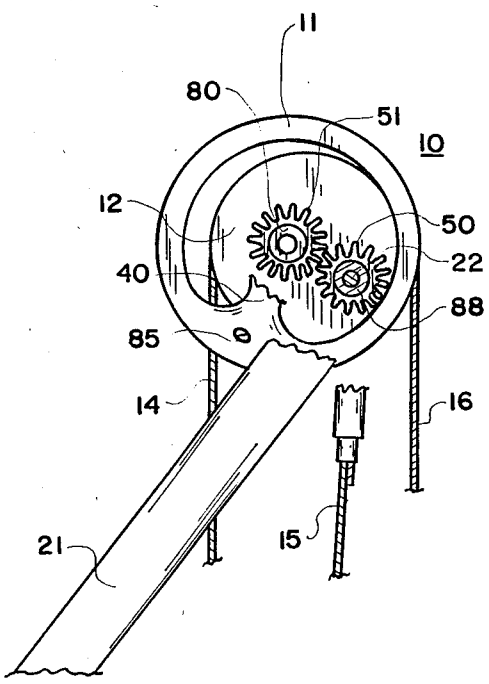
FIG. 5 is a side view of the pulley system with certain structures removed to show the relationship between the pulleys.

FIG. 5 shows a cut away view of pulley system 10 showing the relationship of the two pulleys 11 and 12. In the embodiment shown, gear 51 is attached at the center of pulley 11 by neck 40. Gear 51 could be any friction surface for defining an orbit. Gear 51 is rigidly affixed to neck 40 so that as it rotates the entire pulley 11 also rotates. Thus, force applied to the rim of pulley 11, by pullng drawstring 16, will cause that pulley to rotate around gear 50 which is fixed stationery to the end of tine 21. The exact motion of the respective pulley and their pulleys will be shown later in th detailed discussion.

FIG. 6, shows th two tine ends 21 of upper limb 20. Pivot pin 22 extends between the tines and holds pulley set 10 in place and acts as the axle for the system. The ends of this pin are locked via locking washers 83. Spacer 62 is inserted on pin 22 and pulley 12 is then put on the pin 22 followed by pulley 11. Also on pin 22 is bracket 60 which supports fixed gear 50 in position.

Bracket 60 contains neck 61 to which cable end 15 is attached. Tension cable 14 is shown extending to a groove cut in the circumferential rim of pulley 12 and locked onto the rim via a set screw (shown in FIG. 8). The same is true for drawstring 16 with respect to pulley 11. While now shown, cable 14 must wind around pulley 12 at least one full turn since, during operation, pulley 12 rotates through approximately 360 degrees. The amount of rotation of pulley 12 determines ultimate draw length.

Figure 7:
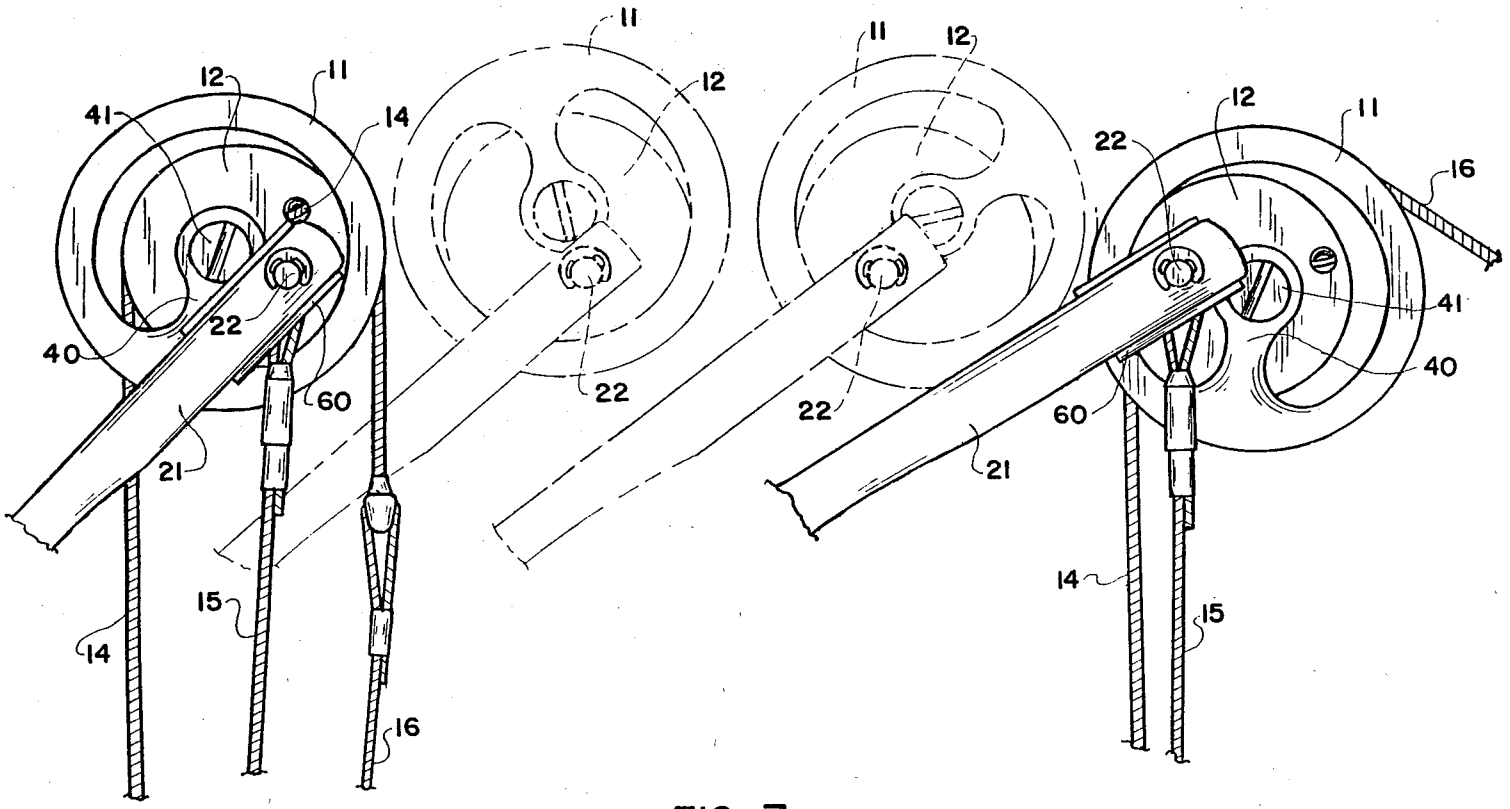
FIG. 7 shows the pulley system, left to right, in various states from rest to fully drawn.

Turning now to FIG. 7, there is shown tine 21 moving from the quiescent position on the far left to the fully drawn position on the far right. Shown for reference in dotted lines are two intermediate positions showing the rotation of cams 12 and 11 around pivot point 22 at the end of the limb arm. Note that in the quiescent position, tension cable 14 is extended to the left of pin 22 a distance of roughly one inch while drawstring cable 16 is approximately ½ inch to the right of pin 22. As drawstring 16 is pulled back, pulley 11 rotates, rotating pulley 12 causing arms 21 to bend. In the final drawn position, tension cable 14 is very near to pin 22 while drawstring 16 is now much further away from pin 22. When cable 16 is in this fully drawn position the forces are such that little relative force is required to keep the bow bent once the drawstring is pulled back because of the relative leverage points of the two cams 11 and 12. Note that the relative sizes of the cams can be changed and the cams can be out of round thereby changing the speed and breakover characteristics of the bow. As shown, the breakover reduction is approximately fifty percent.

Figure 8:
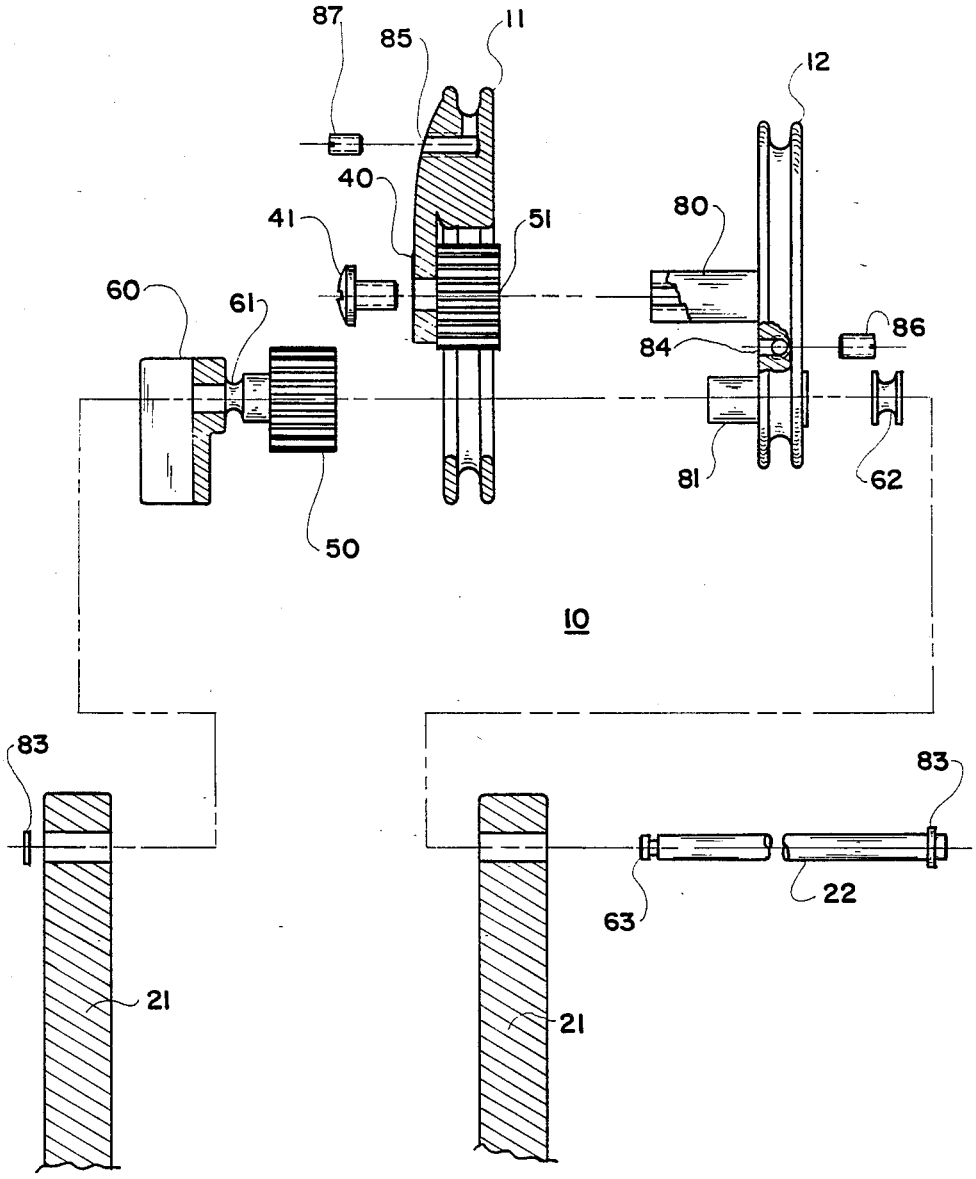
FIG. 8 is an exploded view of the pulley system.

Turning now to FIG. 8, we can see the various parts of pulley set 10 which controls the compound bow. Pin 22 extends between tine ends 21 of the upper bow limb and is held in position by locking washers 83. Fixed gear 50, which in the embodiment is shown detachable from tine end 21 via bracket 60, is slipped over the end of tine 21. Bracket 60 has neck 61 for holding the tension cable which extends from the opposite limb. Bracket 60, neck 61 and gear 50 are a unitary structure. Pulley 11 is then fitted over gear 50 such that gear 51 is in meshing contact with fixed gear 50. The gears provide positive traction and any mechanism, such as a wheel, can be used to rotate pulley 11 around an orbit defined by gear 50. The relative distance of this orbit can be controlled by the diameter of either of these wheels, thereby changing the operational characteristics of the system. The relative placement of the gears will also effect the draw length.

Note also that pulley 11 has an outer rim which is separate from the center section with the center section being open except for neck 40 which extends downwards into the center of the rim holding the orbit defining gear 51 in position for rotation around center hub 80 of pulley 12.

Pulley 12 is shown having hole 84 in its circumferential rim into which tension cable 14 is inserted and locked via screw 86. This is the same locking mechanism used for pulley 11 where screw 87 locks drawstring 16 into hole 85.

Center hub 80 is permanently affixed to gear 12 and in one embodiment, has a center tap therein. The outer bearing surface of hub 80 is adapted to mate with the inner surface of gear 51 such that when pulleys 11 and 12 are mated together hub 80 goes through the center planetary of gear 51 and is held in place by screw 41. Of course this mechanism can be replaced by any other mechanism types which serve to hold the two pulleys together and allows free turning of both pulleys with respect to each other.

Turning crank 81 is off-center from hub 80 and closer to the circumferential rim of pulley 12. Crank 81 extends through the hollow inner section of pully 11 and is inserted through the center of gear 50. This in turn allows pulley 12 to rotate around a center point defined by the center of off-set crank 81 and driven by hub 80 as pulley 11 is forced to orbit gear 50. Because of the open section on the internal section of pulley 11, pulley 11 is free to rotate one full turn while pulley 12 rotates one-half turn as has been demonstrated. Pin 22 extends through tine 21 and through crank 81, gear 50, support 60 to the opposite tine 21, thereby creating an axle around which gear system 10 rotates.

Conclusion

While a pulley system has been discussed in which the two pulleys are shown round with interlocking drive gears it is understood that many variations of this concept can be designed, all within the spirit and scope of the invention. For example the round pulleys could be oval-shaped to provide even more forward acceleration to the drawstring. The pitch of the gear teeth can be modified to control friction. Many other additional adjustments can be made to reduce friction, such as better pivot bearings and perhaps a different balance and size of one or the other of the pulleys. Also, the gears themselves can be made in the form of cams to change the motion of the wind-up and wind-down of the pulley system.

A shield can be constructed for protecting the gears. This shield can be connected to one of the gears, for example, gear 12, and can rotate therewith while covering both gears. This shield would be an added safety factor.

The present disclosure includes that contained in the appended claims as well as that of the foregoing description. Although this invention has been descirbed in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A control mechanism for a bow comprising:

a first pulley for attachment to one end of the drawstring of said bow, said first pulley having a circumferential portion around which said drawstring can be wound and a portion internal to said circumferential portion for controlling the orbit of said circumferential portion;

means for establishing at a first end of said bow a first orbit around which said first pulley orbit controlling portion may traverse and for also establishing a center point of said first orbit;

a second pulley for attachment to one end of a tension cable, the other end of said tension cable attachable to a second end of said bow, said second pulley having a circumferential portion around which said tension cable can be wound, said second pulley including:

means off-set from the center thereof for pivoting said second pulley around said established first orbit center point; and means at the center thereof for attachment to said first pulley for driving said second pulley around said pivot means while said first pulley traverses said orbit establishing means.

2. The apparatus as set forth in claim 1 wherein said second pulley attachment means is driven from a center point of said first pulley.

3. The apparatus as set forth in claim 1 wherein said first orbit is established by a non-rotatable first gear having a radius R1 and number of teeth T1, and wherein said first pulley orbit control means includes a second gear having a radius R2 and number of teeth T2.

4. The apparatus as set forth in claim 3 wherein R1=R2 and T1=T2.

5. The invention as set forth in claim 3 wherein the draw length of said drawstring is controlled by radius R2.

6. The apparatus as set forth in claim 1 wherein said first orbit is established by a non-rotatable first wheel and wherein said first pulley orbit control means includes a second wheel and wherein said second wheel has a center hole therethrough; and wherein said second pulley attachment means is a bearing rod attached to the center of said second pulley, said rod adapted for insertion through a center hole in said second wheel.

7. The apparatus as set forth in claim 6 further including fastening means for maintaining said rod within said second wheel center hole while still allowing said rod to rotate around its center line independent of the rotation of said first pulley.

8. The apparatus as set forth in claim 1 wherein said first and second pulleys are essentially round.

9. The apparatus as set forth in claim 2 wherein the traversed orbit of said first and second pulleys form an orbit elliptical about said bow end.

10. The apparatus as set forth in claim 9 wherein said elliptical orbit of said first pulley encompasses approximately one complete rotation of said pulley around its own midpoint as the drawstring goes from the quiescent position to its fully drawn position, and wherein said elliptical orbit of said second pulley encompasses approximately a half-rotation of said second pulley around its pivot point while said drawstring goes from said quiescent position to said fully drawn postion.

11. The apparatus as set forth in claim 10 wherein, upon release of said drawstring from said fully drawn position said second pulley rotates a half-turn to its quiescent position causing said first pulley to rotate a full turn back to its quiescent position whereby said drawstring is pulled toward said bow with a steadily increasing acceleration until said quiescent position of said drawstring is achieved.

12. A pulley mechanism for use on a compound bow having an upper limb and lower limb, each said limb having an end portion including orbit defining bearing surfaces, said orbit defining means having a center point, said bow having a drawstring extending between said limb end portions and having a first tension control cable connected to said lower limb end portion and a second tension control cable connected to said upper limb end portion, said mechanism comprising a pair of first pulleys each having means for attaching one end of said drawstring to the circumference thereof;

a pair of second pulleys each having means for attaching the free end of either said first or said second tension cables to th circumference thereof;

each of said first pulleys having bearing means mounted central to said circumferential portion, said bearing means having an inner and an outer bearing surface;

means for maintaining said outer bearing surface of each said first pulleys in mating relationship with said orbit defining bearing surface face of either said upper or said lower limb, said maintaining means including a first shaft through the center of said second pulley and affixed thereto and extending through said inner bearing surface of said first pulley, and including a second shaft off-set from said first shaft and affixed to said second pulley, said second shaft extending through said center point of said orbit surface.

13. The apparatus as set forth in claim 12 wherein said first pulley includes a circular ring having an outer bearing surface for winding up said drawstring there around and a hollow area central to said ring;

a neck piece extending from one portion of said ring inward to a point central to said ring; and means for rigidly affixing said first pulley bearing means to said neck piece.

14. The apparatus as set forth in claim 13 wherein said off-set shaft of said second pulley extends through said hollow area of said first pulley.

15. The apparatus as set forth in claim 12 wherein said bearing means and said orbit defining means are gears rigidly affixed to their respective mounting surfaces.

16. The apparatus as set forth in claim 15 wherein said gears have equal numbers of teeth.

17. The apparatus as set forth in claim 12 wherein said first shaft of said second pulley forms a bearing surface for the inner bearing surface of said first pulley bearing means.

18. The apparatus as set forth in claim 12 wherein each said limb end portion has a split tine portion and wherein said orbit defining bearing surface is connected to a first tine by a pin which extends through said second tine, and wherein said pin also extends through said second off-set shaft of said pulley.

19. A set of pulleys for use in substitution for the cams of a compound bow where said bow has upper and lower limbs each end of which is adapted to receive a set of cams for assisting in bending the bow when the drawstring is drawn back, each said set of cams arranged such that the circumference of a first cam is attached to said drawstring and such that the circumference of a second cam is attached to a tension cable which is attached to the end of the other bow limb, said cam sets arranged to cooperate with each other such that when said drawstring is drawn back said first cam turns in response thereto thereby turning said second cam which in turn winds up said tension cable so as to bend said upper and lower limbs toward said drawstring, said cams further arranged such that when said drawstring is released said bent limbs return to their quiescent position thereby rotating said second cams which in turn winds up said drawstring causing said drawstring to move toward said bow to its quiescent position, said set of pulleys comprising:

a first pulley for replacing said first cam, said pulley including;

a circumferential rim around which said drawstring winds; and a drive wheel rigidly affixed at the center of the area defined by said circumferential rim;

a second pulley for replacing said second cam, said second pulley including a circumferential rim around which one of said tension cables winds;

a turning shaft rigidly affixed at the center of the area defined by said circumferential rim; and an orbit defining shaft off-set from said turning shaft and rigidly affixed to said second pulley at a point between said turning shaft and said circumferential rim;

an orbit defining wheel adapted for mounting at the end of said limb in a manner such that said wheel does not rotate; and means for mating said first pulley drive wheel with said orbit defining wheel such that as said drawstring unwinds around said circumferential rim of said first pulley said first pulley is caused to orbit around said orbit defining wheel, said mating means including means for connecting said orbit defining shaft of said second pulley with said end of said limb.

20. The apparatus as set forth in claim 19 further comprising:

means for connecting said first pulley with said turning shaft of said second pulley such that when said first pulley obits around said orbit defining wheel said second pulley is caused to orbit around said orbit defining shaft.

21. The apparatus as set forth in claim 20 wherein said drive wheel and said orbit defining wheel are gears having equal numbers of teeth.

22. The apparatus as set forth in claim 19 wherein said first pulley includes a circular ring having an outer bearing surface for winding up and drawstring there around and a hollow area central to said ring;

a neck piece extending from one portion of said ring inward to a point central to said ring; and means for rigidly affixing said drive wheel to said neck piece.

23. The apparatus as set forth in claim 19 wherein said first shaft of said second pulley forms a bearing surface for an inner bearing surface of said first pulley drive wheel.

24. The apparatus as set forth in claim 19 wherein each said limb end portion has a split tine portion and wherein said orbit defining bearing surface is connected to a first tine by a pin which extends through said second tine, and wherein said pin also extends through said second off-set shaft of said second pulley.

25. The apparatus as set forth in claim 24 wherein said drive wheel and said orbit defining wheel are gears having equal numbers of teeth.

26. The apparatus as set forth in claim 24 wherein said first pulley includes a circular ring having an outer bearing surface for winding up said drawstring there around and a hollow area central to said ring;

a neck piece extending from one portion of said ring inward to a point central to said ring; and means for rigidly affixing said first drive pulley drive wheel to said neck piece.

27. The apparatus as set forth in claim 24 wherein said first shaft of said second pulley forms a bearing surface around which inner bearing surface of said first pulley drive wheel can rotate.

28. The apparatus as set forth in claim 24 wherein each said limb end portion has a split tine portion forming a "U" at the end of said bow limb, and wherein said orbit defining wheel is connected within said "U" and to a first said tine by a pin which extends through said second tine, and wherein said rod also extends through said second off-set shaft of said second pulley.

29. A compound bow where the bow has upper and lower limbs each end of which is adpated to receive a set of pulleys for assisting in bending the bow when the drawstring is drawn back, each said set of pulleys arranged such that the circumferential rim of a first pulley is attached to said drawstring and such that the circumferential rim of a second pulley is attached to a tension cable which is attached directly to the end of the other bow limb, said pulley sets arranged to cooperate with each other such that when said drawstring is drawn back said first pulley turns in response thereto thereby turning said second pulley which in turn winds up said tension cable so as to bend said upper and lower limbs toward said drawstring, said pulley further arranged such that when said drawstring is released said bent limbs return to their quiescent position thereby rotating said second cams which in turn winds up said drawstring causing said drawstring to move toward said bow to its quiescent position;

said first set of pulleys including a drive wheel, the center of which is rigidly affixed at the center of the area defined by said first pulley circumferential rim;

said second pulley including a turning shaft rigidly affixed at the center of the area defined by said second pulley circumferential rim;

an orbit defining shaft off-set from said turning shaft and rigidly affixed to a point between said turning shaft and said second pulley circumferential rim;

said bow including an orbit defining wheel adapted for mounting at the end of each said limb in a manner such that said wheel does not rotate;

means for mating said drive wheel of said first pulley with said orbit defining wheel of said limb end so that as said drawstring unwinds around said circumferential rim of said first pulley said first pulley orbits around said orbit defining wheel, said mating means including means for connecting said orbit defining shaft of said second pulley with said end of said limb; and means for connecting said first pulley with said turning shaft of said second pulley such that when said first pulley obits around said orbit defining wheel said second pulley is caused to orbit around said orbit defining shaft.

30. The method of establishing a compound bow comprising the steps of:

establishing at a first end of said bow a first orbit wheel having a center point;

mating with said established first orbit wheel a first pulley having a circumferential portion around which the drawstring of said bow can be wound, said mating including a second orbit wheel mounted within said circumferential portion;

mating with said first pulley a second pulley having a circumferential portion around which the tension cable of said bow can be wound, said second pulley having a pivot point off-set from the center of said second pulley for connecting to said established first orbit wheel center point; and said mating step including rotatably attaching said second pulley to the center of said second orbit wheel for driving said second pulley around said off-set point while said second orbit wheel traverses said first orbit wheel.

31. The method as set forth in claim 30 wherein said first orbit wheel is a non-rotatable first gear having a radius R1 and number of teeth T1, and wherein said second orbit wheel is a second gear having a radius R2 and number of teeth T2.

32. The method as set forth in claim 31 wherein R1=R2 and T1-T2.

33. The method as set forth in claim 30 wherein said second gear has a center hole therethrough; and wherein said second pulley rotatable attachment step includes insertion of a bearing rod which is attached to the center of said second pulley through said second gear center hole.

34. The method as set forth in claim 30 wherein said bow limbs each have tine ends, each tine having a hole therethrough said establishing step and said first and second pulley mating steps icludes the step of inserting a rod bearing surface through said center point of said first wheel, through said pivot point of said second pulley and through said holes in said tine ends of said bow limbs.

* * * * *